United States Patent [19]

Halverson

[11] Patent Number: 4,819,287

[45] **Date of Patent: * Apr. 11, 1989**

[54] MATTRESS TO SUPPORT A WOMAN DURING PREGNANCY

[75] Inventor: Debra A. Halverson, Hillsborough Township, Somerset County, N.J.

[73] Assignee: Jabiru Incorporated, Flagtown, N.J.

[ * ] Notice: The portion of the term of this patent subsequent to Apr. 19, 2005 has been disclaimed.

[21] Appl. No.: 156,603

[22] Filed: Feb. 17, 1988

Related U.S. Application Data

[63] Continuation-in-part of Ser. No. 9,810, Feb. 2, 1987, Pat. No. 4,737,999.

[51] Int. Cl.[4] ..... A47C 27/10

[52] U.S. Cl. ..... 5/455; 5/464; 5/431

[58] Field of Search ..... 5/448, 431, 434, 436, 5/462, 464, 441, 449, 455, 465

[56] References Cited

U.S. PATENT DOCUMENTS

| | | | |
|---|---|---|---|
| 1,576,211 | 3/1926 | O'Kane | 5/455 |
| 2,491,557 | 12/1949 | Goolsbee | 5/455 |
| 2,582,439 | 1/1952 | Kavanagh | 5/455 |
| 3,276,046 | 10/1966 | Capelli | 5/436 |
| 3,303,518 | 2/1967 | Ingram | 5/456 |
| 3,840,920 | 10/1974 | Voelker | 5/455 |
| 4,051,566 | 10/1977 | Esquivel | 5/446 |
| 4,054,960 | 10/1977 | Pettit et al. | 5/435 |
| 4,428,087 | 1/1984 | Horn | 5/455 |
| 4,489,452 | 12/1984 | Lickert | 5/455 |
| 4,617,690 | 10/1986 | Grebe | 5/455 |

FOREIGN PATENT DOCUMENTS

| | | | |
|---|---|---|---|
| 1202100 | 1/1960 | France | 5/455 |

*Primary Examiner*—Alexander Grosz
*Attorney, Agent, or Firm*—Kenneth P. Glynn

[57] ABSTRACT

The present invention is directed to a mattress for pregnant women which has a main mattress section with an opening therein for serial cushions for abdominal support. A plurality of cushions are serially arranged within one another and are located within the opening of the main mattress section. At least one of the cushions is non-inflatable to enhance structural support. The cushions may all be non-inflatable, e.g. foam, but at least one must be non-inflatable for structural support. In a preferred embodiment, at least some of the cushions have a height which is in excess of the height of the main mattress section.

18 Claims, 4 Drawing Sheets

MATTRESS TO SUPPORT A WOMAN DURING PREGNANCY

REFERENCE TO RELATED APPLICATIONS

This application is a continuation-in-part of U.S. application Ser. No. 07/009,810, filed on Feb. 2, 1987 now U.S. Pat. No. 4,737,999 by Debra A. Halverson, entitled "Maternity Mattress."

BACKGROUND OF THE INVENTION

1. Field of the Invention

The present invention relates to mattresses and, more particularly, to mattresses for supporting pregnant women wherein a plurality of physiological needs which are peculiar to pregnant women are satisfied.

2. Prior Art Statement

Custom fill mattresses as well as air mattresses are well known and have been in existence for a number of decades. Typically, air mattresses are made up of a plurality of channels or chambers which have heat seal-type seams and with plastic or plasticized canvas-type material whereby the typical air mattress has a single inflation nozzle and the air is blown into the air mattress so as to inflate all of the chambers. In 1984, U.S. Pat. No. 4,428,087 issued to Friedrich Horn and was directed to a therapeutical air mattress. In this particular air mattress, there was an inflatable hollow body provided with a pair of symmetrically arranged longitudinal air tubes which form an inflatable single chamber system and which almost adjoin one another in a head region and were spaced from one another in a body region so as to satisfy the particular needs of a patient lying in the mattress in such a manner that the mattress could be set in rhythmical vibrations. Typically, this therapeutical air mattress was used to treat people with articular rheumatism and/or with blockages of the vertebrae and articulations.

In addition to the general state of the art of air mattresses, some patents have been issued which are directed to custom mattresses designed specifically for pregnant women. U.S. Pat. No. 3,840,920 issued on Oct. 15, 1974 to Walter Voelker is directed to an adjustable mattress for pregnant mothers wherein separate compartments were provided in the design with each compartment containing non-resilient flowable material. More specifically, various types of cellular material as well as other choice materials listed in the patent would be used in conjunction with spheres which operated in a thixotropic fashion. The particular structure described in this patent was to be divided into separate chambers including one located in the general enlarged abdominal area of the pregnant woman whereby different flowability characteristics of the flowable material could be maintained or, in the alternative, the flowability of the flowable material in each compartment was continuously or intermittently altered by altering the volume of the envelope, either mechanically or by altering gas pressure or liquid pressure in the compartment, thus causing the slightly elastic envelope to increase or decrease in volume.

U.S. Pat. No. 4,051,566 issued on Oct. 4, 1977 to Lucy Esquivel is directed to a mattress with a modifiable cavity for pregnant women. Basically, this patent teaches a mattress structure which has an insert in a cavity which is movably mounted so that it may be raised or lowered to accommodate a woman who is pregnant in such a fashion that she may lay on the mattress face down with her abdomen in the cavity. Specifically, a hand crank is provided whereby the cavity section with the insert may be cranked so that the insert may be raised or lowered.

U.S. Pat. No. 4,489,452 is directed to a prenatal mattress and issued on Dec. 25, 1984 to Jodey Lickert. This patent describes a prenatal mattress enabling a pregnant woman to lie more comfortably and safely on her abdomen during the pregnancy term. The mattress comprises a lower layer of cloth carrying releasable fasteners, a fluid-fillable abdominal cushion, and a fluid-fillable head cushion. An upper layer of cloth is provided so as to seal the cushion and headrest in place. The cushions can be filled to the extent desired with a fluid, placed between the areas and the fasteners can be attached so as to form the mattress. In a preferred embodiment, the cushion has dual indentations to accommodate the breasts of the pregnant woman and a lower indentation to accommodate the thighs or upper leg areas.

U.S. Pat. No. 4,054,960 to John and Dorothy Pettit describes an inflatable body support cushion particularly developed for support of a woman during pregnancy. The mattress has adjustable inflatable cushion supports for the entire length of a prone, face down, expectant mother. Various aspects are directed to an opening for the head, a removable cushion for the enlarged abdomen and a special opening to accommodate the mother both during and after childbirth.

U.S. Pat. Nos. 3,276,046 and 2,582,439 are directed to adjustable cushions, one with removable sections for the head and the other adjustably deflatable. Additionally, other United States Patents, such as U.S. Pat. Nos. 4,617,690; 3,303,518; 2,491,557; 1,576,211 and French Patent No. 1,202,100 describe various mattress arrangements with sectional portions which are custom designed, removable or adjustable.

Notwithstanding all of the prior art, there appears to be no patent or reference which teaches or renders obvious some of the critical features of the present invention which includes a plurality of concentric cushions, each being independently filled, at least one of which is non-inflatable, and which are designed to take into consideration different size enlarged abdomens of pregnant women, different size breasts, different size thighs, and different relative locations among these body parts as well as consideration for the needs of other body parts.

Thus, the prior art is believed to establish the state of the art and to establish the patentability of the present invention.

SUMMARY OF THE INVENTION

The present invention is directed to a mattress for pregnant women which has a main mattress section with an opening therein for serial cushions for abdominal support. A plurality of cushions are serially arranged within one another and are located within the opening of the main mattress section. At least one of the cushions is non-inflatable to enhance structural support. The cushions may all be non-inflatable, e.g. foam, but at least one must be non-inflatable for structural support. In a preferred embodiment, at least some of the cushions have a height which is in excess of the height of the main mattress section.

BRIEF DESCRIPTION OF THE DRAWINGS

The present invention will be more fully understood in light of the specification and drawings, wherein.

DETAILED DESCRIPTION OF THE PRESENT INVENTION

Figure 1:
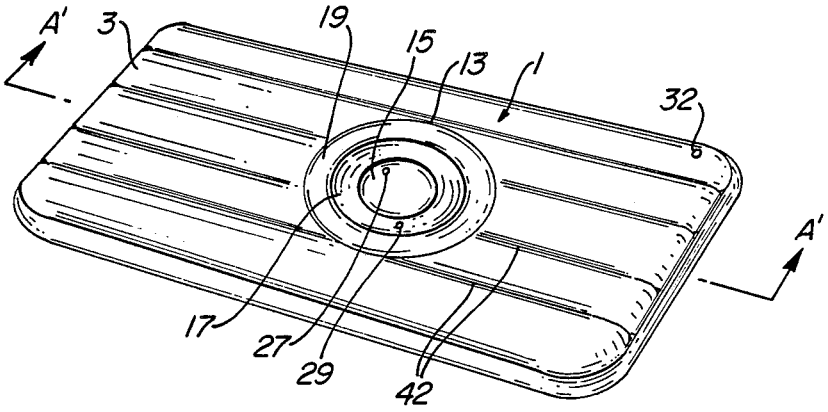
FIG. 1 is a perspective view of a maternity mattress of the present invention showing a plurality of cushions serially arranged within one another.

Mattress 1 for a pregnant woman is shown in FIG. 1 and has a main mattress section 3 of conventional configuration as shown, but has an opening 13 for round cushion 15 and serial toroidal cushions 17 and 19. As shown, cushion 15 is a round inflatable cushion and cushions 17 and 19 are toroidal or doughnut-like in structure. While mattress 1 is shown, in this case, as an inflatable mattress and includes inflation port 32, it should be noted that the mattress may be of any conventional material of construction and design. Thus, it may be an air mattress, a water mattress, a foam mattress, or any other type of conventional mattress material.

Cushions 15 and 17 have inflation ports 27 and 29 respectively as shown. These are arranged in no particular order, except that they should be designed so as to be pushed in and not be an impediment or protrusion which would annoy, irritate or harm the user. Cushion 19 is non-inflatable, and, in this embodiment, is foam filled.

The non-inflatable cushion or cushions utilized in the present invention mattresses may be adjustable or non-adjustable and are made of any semi-flexing or flexible material and may be integral foam, foam pieces, molded foam, beads, loose filler such as is used in conventional pillows, e.g. rag, feather or the like, or may have any other material which will be comfortable to rest upon. The parent application to this application, cited above, describes the mattress with inflatable cushions. It has now been discovered that unexpected abdominal support can be obtained and side shifting of the cushions can be reduced if at least one of the cushions is non-inflatable. Hence, the present invention mattress includes at least one cushion which is non-inflatable.

Figure 2:
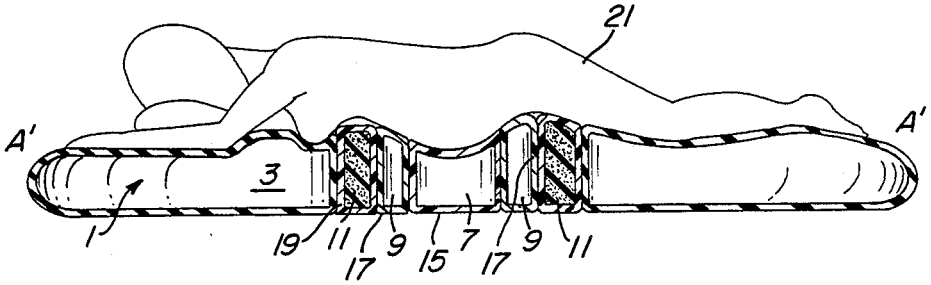
FIG. 2 is a side cut view of the mattress of the present invention shown in FIG. 1, but cut along line A' A', and includes a profile of a pregnant woman utilizing the mattress and includes a non-inflatable outside ring.

FIG. 2 shows a side cut view of mattress 1 which is shown in FIG. 1 as cut along line A' A'. Also included in FIG. 2 is a side view of pregnant woman 21 lying on her stomach. In this case, pregnant woman 21 is only slightly enlarged in the abdominal area and thus in her early term of pregnancy. Center cushion 15 contains air 7 and cushion 17 contains air 9. Outside ring cushion 19 contains molded flexible foam 11, as shown. Using mattress 1 at this stage of the pregnancy, pregnant woman 21 would let some of the air out of cushion 15 and most probably keep full air in cushion 17. Both inflatable cushion 17, and foam cushion 19 would support the chest and hips and thighs, as shown. As mentioned above, the main mattress section 3 of mattress 1 can be made of any material and may be air, water, foam, spring or the like.

Figure 3:
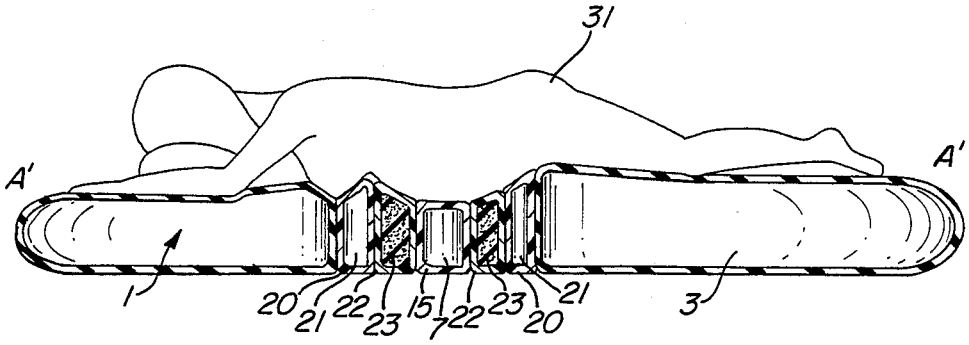
FIG. 3 is a cut side view of the mattress shown in FIG. 1, along line A' A', showing a pregnant woman, here more fully along in her term and includes a non-inflatable inside ring.

FIG. 3 shows pregnant woman 31 in about her seventh or eighth month of pregnancy utilizing present invention mattress of the type shown in FIG. 1, designated as 1 here. There is a cut side view of mattress 1 shown and a profile of pregnant woman 31. Parts which are the same as in FIG. 1 are like numbered. In this embodiment as shown, a considerable amount of air 7 is deflated from center cushion 15. Outer cushion 20, contains air 21, as shown, and inner ring cushion 22 contains foam 23. A larger recess is created for the abdominal area due to the deflated center cushion 15 and the extra weight. Also, there is some accommodation for enlarged breasts as shown. The cushions 15, 20 and 22 shown herein are integral parts of mattress 1 and are not removable. Thus, in this particular embodiment, they may be heat sealed and integral parts as shown with wall dividers. However, these could be removable or detachably removable as shown and as discussed in more detail in conjunction with FIG. 6 below.

Figure 4:
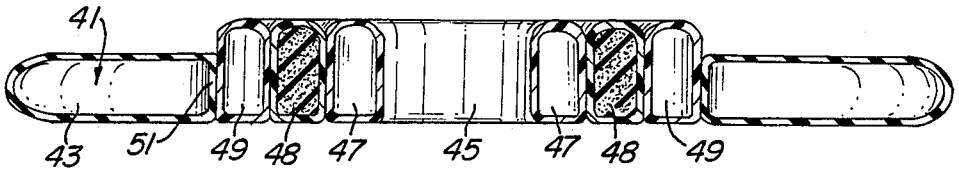
FIG. 4 is a side view of another embodiment of the present invention cut along the vertical midsection thereof and includes a non-inflatable center ring.

FIG. 4 shows an alternative embodiment in its cross-section side view wherein the serial toroidal cushions are designed so as to have a height which is in excess of the height of the mattress itself. Thus, in FIG. 4, present invention mattress 41 is shown having a main mattress section 43 with an opening 51 therein. In this embodiment, a total of three ring cushions are shown instead of two rings and a center cushion, and the exact number of cushions is not critical. However, it is important that a plurality of cushions be employed so as to allow significant adjustability and give for the pregnant woman. In the present embodiment shown in FIG. 4, opening 45 is shown instead of a center cushion, toroidal cushions 47, 48 and 49 are serially or concentrically arranged. Outer toroidal cushion 47 and inner toroidal cushion 49 are inflatable. The inflation ports are not shown. Central toroidal cushion 48 is filled, e.g. with foam, beads, or the like.

Figure 5:
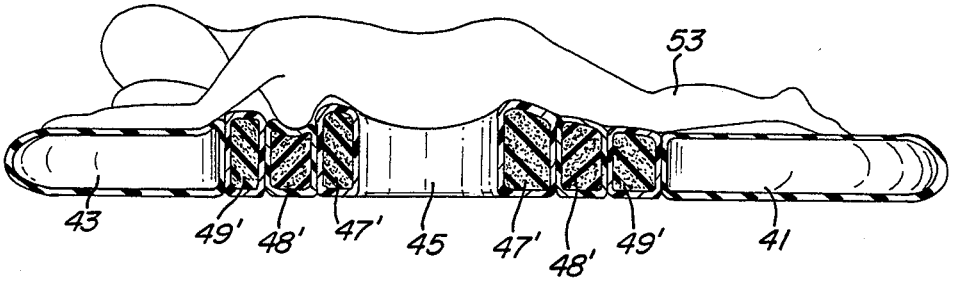
FIG. 5 is a side cut view showing a pregnant woman using the mattress of the present invention of the type shown in FIG. 4 but includes all cushions being non-inflatable.

FIG. 5 shows the mattress of the type shown in FIG. 4, with all cushions filled instead of only the central toroidal cushion being filled. Like parts between FIGS. 4 and 5 are like numbered. Thus, the present invention mattress 41 of FIG. 5 having a pregnant woman 53 thereon, is shown so as to accommodate pregnant woman 53's knee, thigh, hip region, enlarged abdomen, lower chest and breasts, and the raised cushions aid to relieve low back pressure. Pregnant woman 53's enlarged abdomen 54 nests in opening 45 as shown. Also, in this embodiment, the cushions are independently removable and not permanently attached so that they may be replaced at a later date by a "dummy" type cushion after the pregnancy is over. While this would be an optional convenience, it would eliminate the necessity of dealing with a plurality of cushions after the pregnancy has been completed and the abdominal area is back to normal.

Figure 6:
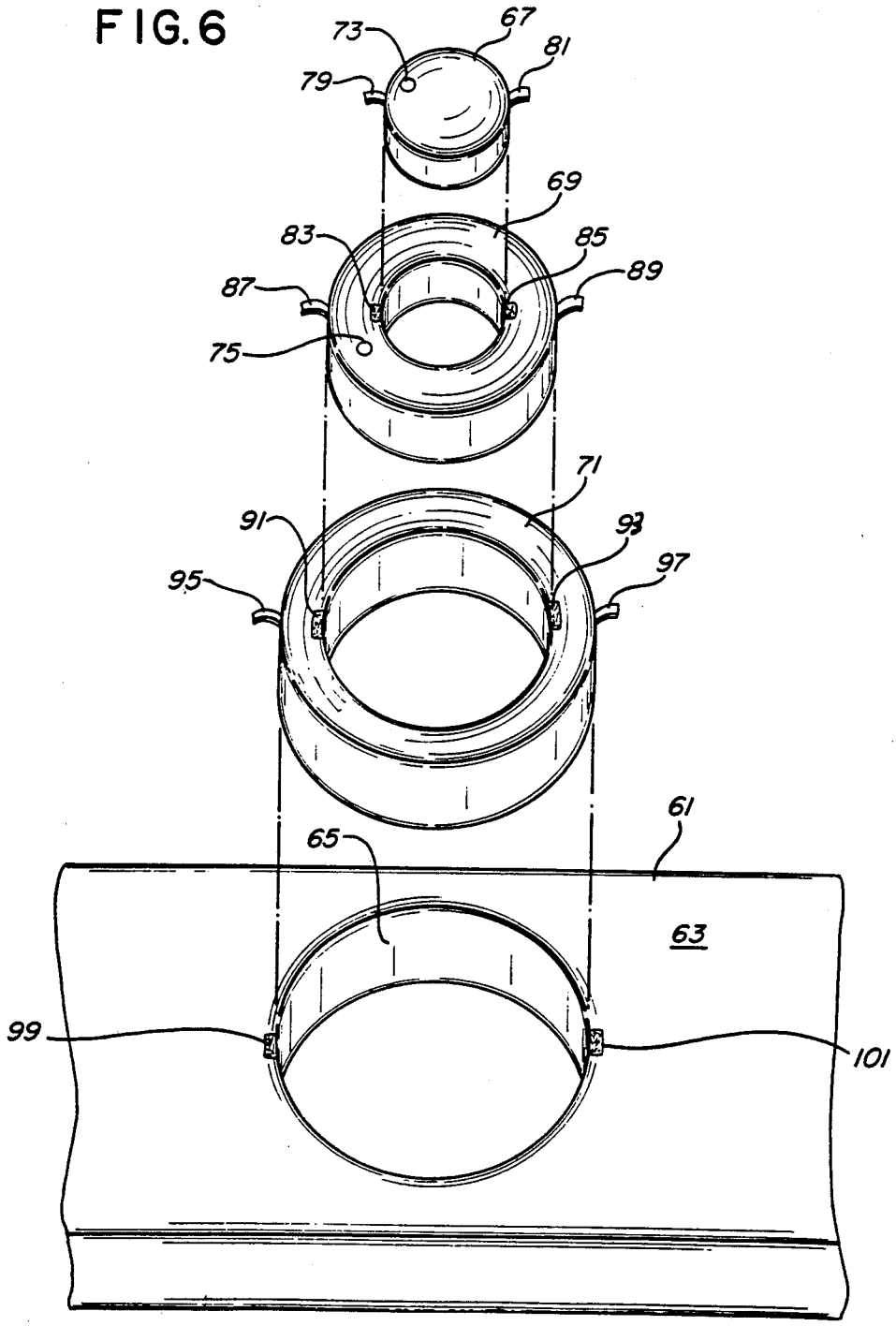
FIGS. 6 and 7 show embodiments of the present invention maternity mattress wherein the cushion sections are attachably removable and segmented, respectively.

FIG. 6 shows present invention mattress 61 having a conventional main mattress section 63 with an opening 65 shown therein. In this embodiment, three cushions, namely optional cushion 67, inflatable cushion 69 and filled cushion 71 are removably insertable into opening 65. As shown, cushions 67 and 69 have inflation ports 73 and 75, respectively. Cushion 67 inserts directly and fits snugly into cushion 69 in their fully inflatable state and cushion 67 has VELCRO ® flaps 79 and 81 which are attachable to opposite VELCRO ® strips 83 and 85 on cushion 69. Likewise, cushion 69 has VELCRO ® flaps 87 and 89 which are attachable to VELCRO ® strips 91 and 93 on cushion 71. Concomitantly, cushion 71 has VELCRO ® flaps 95 and 97 which attach to VELCRO ® strips 99 and 101 on main mattress section 63. In this manner, each of the cushions are attachable to one another and will not pop out or move around. Obviously, the attachment means are not essential as discussed in conjunction with FIGS. 4 and 5 above, however, they are preferred. Also, it should be noted that, although VELCRO ® attachment means are shown, other attachment means such as padded buttons, hooks, or any other known-attachment means could be used.

Figure 7:
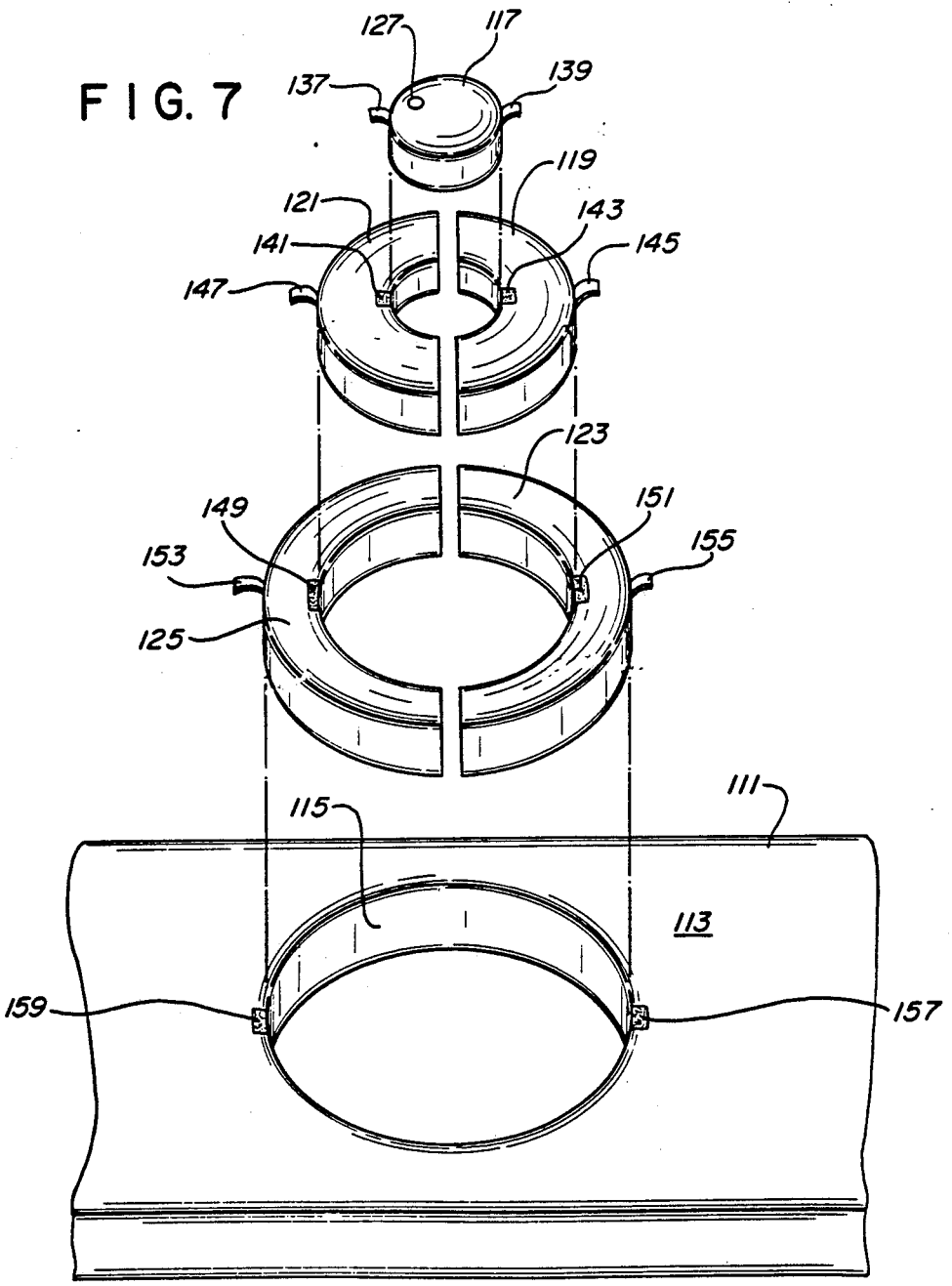

FIG. 7 shows a present invention mattress 111 having a conventional main mattress section 113 with an oval opening 115 shown therein. In this embodiment, five cushions, namely cushion 117 and cushion sections, i.e., half cushions 119, 121, 123 and 125 are removably insertable into opening 115. As shown, the round cushion 117 has an inflation port 127. Half cushions 119, 121, 123 and 125 are all filled non-inflatable, half toroids, e.g. with foam, beads, feather, or the like. Cushion 117 inserts directly and fits snugly into half cushions 119 and 121 and cushion 117 has VELCRO ® flaps 137 and 139 which are attachable to opposite VELCRO ® strips 141 and 143 on cushions 121 and 119 respectively. Likewise, cushions 119 and 121 have VELCRO ® flaps 145 and 147 which are attachable to VELCRO ® strips 149 and 151 on cushions 125 and 123. Concomitantly, cushions 123 and 125 have VELCRO ® flaps 155 and 153 which attach to VELCRO ® strips 157 and 159 on main mattress section 113. In this manner, each of the cushions are attachable to one another and, coupled with a snug fit, will not pop out or move around. Obviously, the attachment means could also include VELCRO ® strips for attachment to a base (not shown) inside opening 115.

Obviously, numerous modifications and variations of the present invention are possible in light of the above teachings. It is therefore understood that within the scope of the appended claims, the invention may be practiced otherwise than as specifically described herein.

What is claimed is:

1. A mattress for a pregnant woman, of a size sufficient to support a substantial portion of the body of a pregnant woman, which comprises:

(a) a main mattress section having an opening for a plurality of toroidal cushions for abdominal support; and, (b) a plurality of individual toroidal cushions which are arranged concentrically and are located within said opening of said main mattress section, at least one of said cushions being non-inflatable.

2. The mattress of claim 1 wherein said plurality of cushions are removable.

3. The mattress of claim 2 wherein said plurality of cushions are inserted into said opening of said main mattress section by merely being placed therein.

4. The mattress of claim 1 wherein said plurality of cushions are removably attached to said mattress at the opening of said main mattress section.

5. The mattress of claim 1 wherein said plurality of cushions are permanently attached to the main mattress section.

6. The mattress of claim 1 wherein said plurality of toroidal cushions are oval in shape.

7. The mattress of claim 1 wherein all of said cushions are non-inflatable cushions.

8. The mattress of claim 7 wherein said plurality of toroidal cushions are oval in shape.

9. The mattress of claim 1 wherein said plurality of cushions includes at least one set of cushion sections to form a toroid.

10. The mattress of claim 1 wherein at least one of said plurality of cushions is permanently attached to said main mattress section.

11. A mattress for a pregnant woman, of a size sufficient to support a substantial portion of the body of a pregnant woman, which comprises:

(a) a main mattress section having an opening for a plurality of toroidal cushions for abdominal support; and, (b) a plurality of individual toroidal cushions which are arranged concentrically and are located within said opening of said main mattress section, and wherein at least a portion of said plurality of cushions have a height which is in excess of the height of the main mattress section and wherein at least one of said cushions is non-inflatable.

12. The mattress of claim 11 wherein said plurality of cushions are removable.

13. The mattress of claim 12 wherein said cushions are inserted into said opening of said mattress section by merely being placed therein.

14. The mattress of claim 11 wherein said plurality of cushions are removably attached to said mattress at the opening of said main mattress section.

15. The mattress of claim 11 wherein said plurality of cushions are permanently attached to the main mattress section.

16. The mattress of claim 11 wherein said plurality of toroidal cushions are oval in shape.

17. The mattress of claim 11 wherein said plurality of cushions includes at least one set of cushion sections to form a toroid.

18. The mattress of claim 11 wherein at least one of said plurality of cushions is permanently attached to said main mattress section.

* * * * *